US005381743A

United States Patent [19]

Moll

[11] Patent Number: 5,381,743

[45] Date of Patent: Jan. 17, 1995

[54] DEVICE FOR MAKING SEAMS ON THREE-DIMENSIONAL OBJECTS

[75] Inventor: Philipp Moll, Aachen, Germany

[73] Assignee: Moll Automatische Näehsysteme GmbH i.g., Germany

[21] Appl. No.: 84,203

[22] PCT Filed: Dec. 24, 1991

[86] PCT No.: PCT/EP91/02508

§ 371 Date: Jul. 2, 1993

§ 102(e) Date: Jul. 2, 1993

[87] PCT Pub. No.: WO92/13986

PCT Pub. Date: Aug. 20, 1992

[30] Foreign Application Priority Data

Jan. 31, 1991 [DE] Germany ..... 4102840

[51] Int. Cl.[6] ..... D05B 21/00

[52] U.S. Cl. ..... 112/121.14; 112/2.1

[58] Field of Search ..... 112/121.14, 2.1, 302, 112/272, 37, 35, 62, 63

[56] References Cited

U.S. PATENT DOCUMENTS

| | | | |
|---|---|---|---|
| 3,775,795 | 12/1973 | Collins et al. | 112/35 X |
| 4,155,317 | 5/1979 | Enomoto | 112/2.1 |
| 4,327,653 | 5/1982 | Blessing | 112/121.14 |
| 4,423,691 | 1/1984 | Schwaab | 112/272 |
| 4,848,252 | 7/1989 | Ciucani | 112/63 X |
| 4,905,615 | 3/1990 | Pofferi | 112/121.14 X |
| 4,989,525 | 2/1991 | Portilla . | |
| 5,022,335 | 6/1991 | Hanyu et al. | 112/302 X |

FOREIGN PATENT DOCUMENTS

| | | | |
|---|---|---|---|
| 0344400 | 1/1989 | European Pat. Off. . | |
| 3338405 | 10/1983 | Germany . | |
| 6329690 | 7/1986 | Japan . | |
| 2119965 | 5/1983 | United Kingdom . | |
| 9114036 | 9/1991 | United Kingdom | 112/121.14 |
| 9212283 | 7/1992 | United Kingdom | 112/121.14 |

*Primary Examiner*—Clifford D. Crowder
*Assistant Examiner*—Paul C. Lewis
*Attorney, Agent, or Firm*—Diller, Ramik & Wight

[57] ABSTRACT

For making seams on three-dimensional objects, a manipulator (20) is used at the manipulator arm (19) of which a sewing machine (18) is secured. The cuttings (12,14) to be sewn are fixed to a holding device (10), and the sewing machine (18) sews the protruding edge strips (16) which confront each other. The sewing machine (18) can be guided by the manipulator arm (19) along the intended seam line at constant speed. While the needle penetrates the material, the sewing machine being guided on a guide (21) by means of a carriage (22) is driven in a direction opposite to the feeding direction of the manipulator so that the sewing machine is at a temporary standstill with respect to the holding device (10). After completion of the stitch, the carriage (22) is advanced on the guide (21) in feeding direction so that the sewing machine catches up with the lag. With each stitch, the edge strip (16) is clamped between a needle plate and a presser of the sewing machine.

9 Claims, 4 Drawing Sheets 48
24
18a
25
47
39
40
50
28
51
33
32
26
30
31
42
27
49

DEVICE FOR MAKING SEAMS ON THREE-DIMENSIONAL OBJECTS

BACKGROUND OF THE INVENTION

The invention relates to a device for making seams on three-dimensional objects made of materials such as textile woven materials, leather, synthetics or similar materials. Such devices are used for the production of clothing, upholstery for seating furniture and automobiles, and for the production of shoes.

Usually, three-dimensional objects such as envelopes made of fabric are manufactured in such a way that pre-made two-dimensional cuttings are sewn lying flat on top of each other with a sewing machine. The two cuttings are sewn together at an exactly specified distance from the cutting edges. Beforehand, the cuttings have been provided with markings which have to match during sewing, and it is also necessary to displace the cuttings relative to each other during sewing. Joining of the cuttings by means of a sewing machine is very time-consuming and requires a high degree of routine of the operator who has to guide the cuttings and operate the sewing machine. Because of the relatively slow manual control, the performance possibilities of the sewing machine are not fully utilized. The feeding of the materials is made by the sewing machine intermittently between the penetration movements of the needle. From DE 33 38 405 A1, a device for producing three-dimensional articles provided with seams is known wherein a sewing machine is attached to a manipulator in the form of a robot arm. This sewing machine is moved by the manipulator in such a manner that said sewing machine is guided along the intended seam line of the two cuttings to be sewn. An under-thread bobbin grips underneath the cuttings to be sewn and a presser presses against the top cutting. The lower cutting is supported by a brush bed through which the under-thread bobbin moves.

A similar sewing device is known from EP 0 344 400 A1. Here, too, a sewing machine is secured to the manipulator arm of a robot, the details of which sewing machine, however, are not described.

The known devices on which a sewing machine is moved by a manipulator in a three-dimensional system involve the difficulty of obtaining a neat and distortion-free seam and still carrying out the sewing action at high working speed.

SUMMARY OF THE INVENTION

It is the object of the invention to provide a vice for making seams on three-dimensional objects, which permits the production of perfect and distortion-free seams.

This object is solved, according to the invention; with the features indicated in claim 1.

In the sewing device according to the invention, the sewing machine comprises a sewing head the movement of which is controlled such that during the penetrations of the needle into the material, it is at a standstill relative to the holding device carrying the workpiece. These standstill actions can be produced in different ways. One possibility is to move the manipulator arm in coordination with the needle movements of the sewing machine along the seam line such that said manipulator arm is at a standstill during the penetration and withdrawal movements of the needle and only moves the sewing machine when the needle is pulled out of the material. Another possibility envisages that the sewing head is movably guided in a linear direction on the manipulator arm such that at the point when the needle is in the material, said sewing head is moved backward along the intended seam line relative to the manipulator arm at about the same speed and afterwards, when the needle is pulled out of the material, the amount of lost movement is caught up again. The manipulator arm can then be moved at constant speed such that the tool center point of the manipulator moves at constant speed along the seam line, the sewing machine, however, alternately falling short of the tool center point and catching up the lost movement again. To this end, a guide is secured to the manipulator arm which guide is always aligned parallel to the intended seam line and along which the entire sewing machine is linearly guided. Finally, it is also possible to move the holding device for the fabric by means of the manipulator arm while the sewing machine is stationary, the entire sewing machine or only the parts of its sewing head being linearly moved to carry out the follower movement.

It is also within the scope of the invention to mount the sewing machine firmly on the manipulator arm and move the sewing head or the individual components thereof along linear ways of displacement such that the sewing head is at a standstill relative to the workpiece during stitching movements of the needle. In this case, too, the manipulator arm can be moved at constant speed, while the back and forth compensating movements are carried out exclusively by the sewing head relative to the sewing machine.

Continuous movement of the manipulator arm has the advantage that the masses which have to be moved intermittently dependent on the stitch movements of the needle can be kept relatively small and that it is not necessary to mutually coordinate the movements of the manipulator arm and the stitching movements of the needle.

In the sewing machine according to the invention, the feeding stroke for sewing the seam is made exclusively by the manipulator arm while the workpiece itself is at a standstill. Here, the holding device carrying the workpiece does not necessarily have to be absolutely fixed, but can be fitted so that it can be turned, for example. It is important that the sewing machine itself has no feeding device and that the material is not moved further between two stitches.

For the purpose of permitting a relative movement of the sewing head with respect to the workpiece between two stitches, the needle plate and the presser are moved apart when the needle is pulled out of the material. In this state, the sewing head (or the entire sewing machine) can be moved by one stitch length relative to the workpiece. After that, the material is again clamped between needle plate and presser in order to provide for an exact position of the workpiece for the next needle stitch and an exact mutual alignment of the cuttings to be sewn.

Hereinafter, embodiments of the invention are explained in detail with reference to the drawings.

In the figures:

DESCRIPTION OF THE PREFERRED EMBODIMENTS

Figure 1:
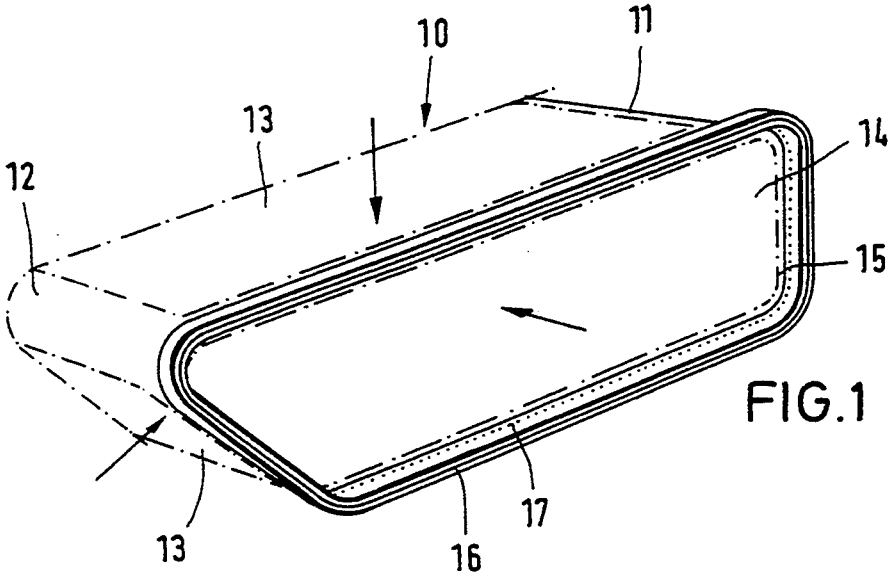
FIG. 1 shows a holding device with cuttings to be sewn together secured on it.

FIG. 1 shows a holding device 10 carrying individual cuttings which are confronted with each other in order to form a three-dimensional hollow object from two-dimensional material. The workpiece to be manufactured the cuttings of which are secured on the holding device 10 consists of the sleeve for an armrest of a motor vehicle.

The holding device 10 comprises a basic body 11 about which a cutting 12 in the form of a bandshaped strip is placed. This cutting 12 is secured on the basic body 11 by holding plates 13 which are pressed against the cutting from the outside. The cutting 12 encompasses the basic body 11. The side of the ring formed by the cutting 12 is to be closed by a cutting 14 in the form of a side part to be sewn on. The cutting 14 is placed against the side surface of the basic body 11 and held there by a holding plate 15 which is pressed against the basic body. Holding of the holding plates 13 and 15 on the basic body 11 can be effected, for example, by magnets or by suction.

Figures 3, 5:
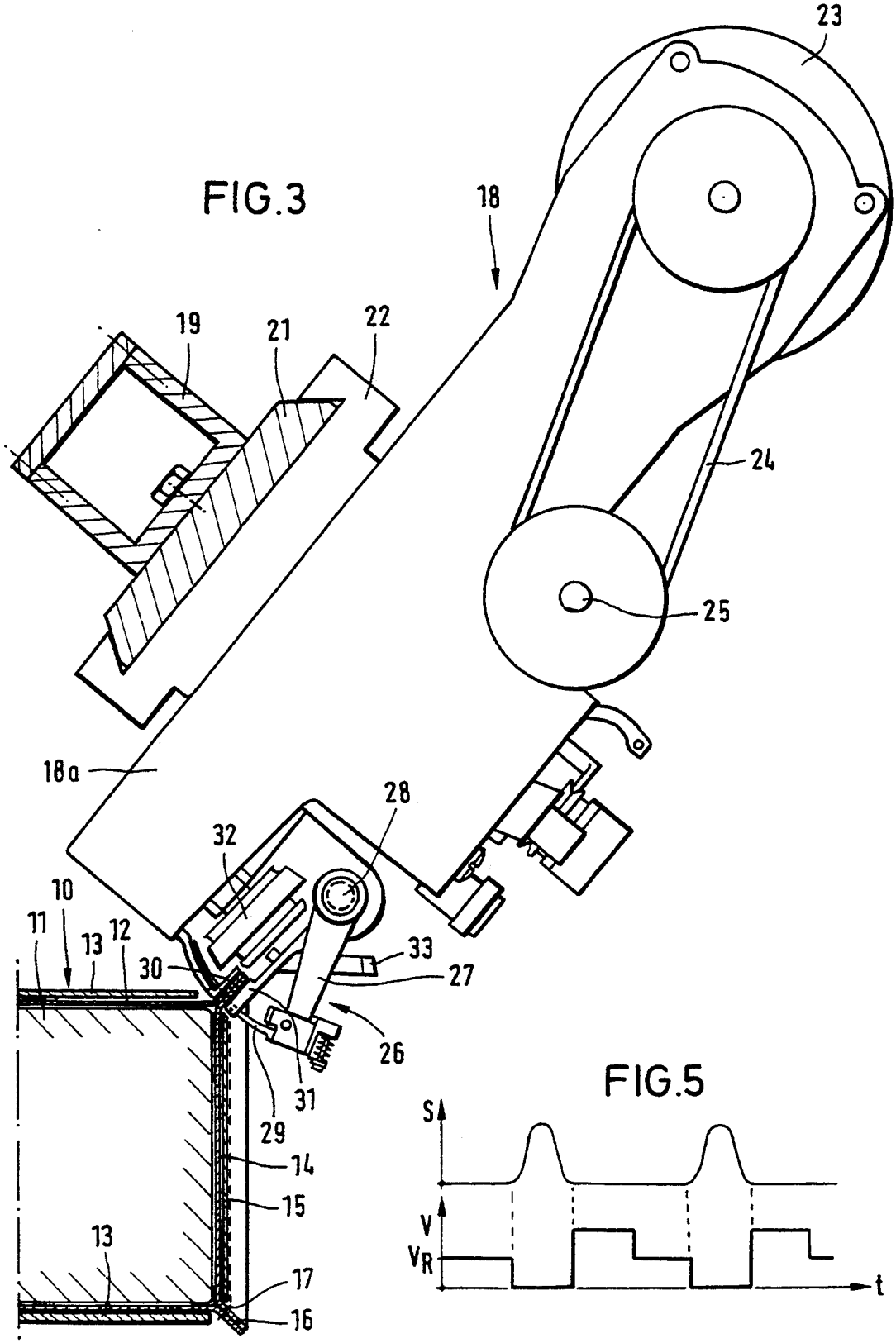

The cuttings 12 and 14 are of such a size that they overlap at the circumferential edges where they form edge strips 16 (see also FIG. 3). At the root of these edge strips 16, the seam 17 is produced.

Figure 2:
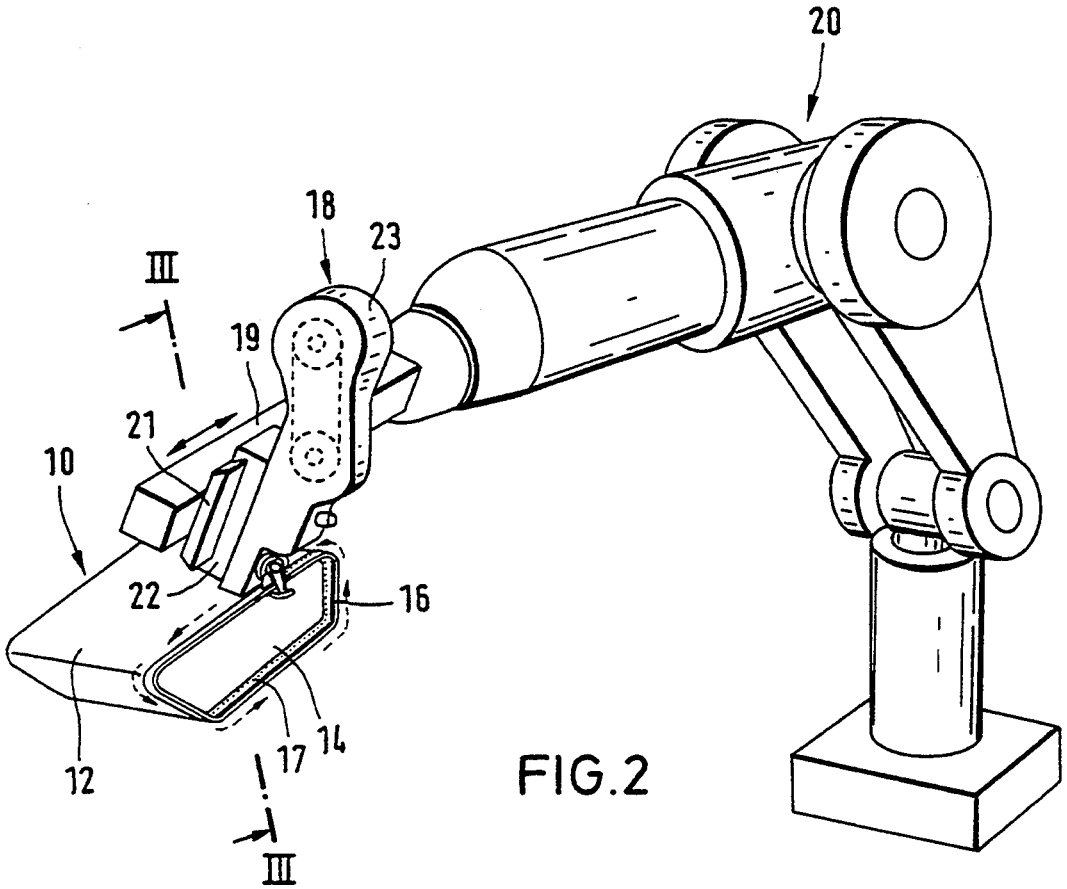
FIG. 2 an illustration of the holding device together with the manipulator and the sewing machine mounted therein, FIG. 3 a section along line III—III of FIG. 2, FIG. 4 a front view of the sewing machine, FIG. 5 a diagram of the time coordination of the movements of the sewing head with the stitch movements of the needle, and FIG. 6 a side view of another embodiment in which the sewing head is linearly movable relative to the sewing machine.

FIG. 2 shows the holding device 10 which is fitted on a holder (not shown) in a stationary manner, and a sewing machine 18 mounted on a manipulator arm 19. The manipulator arm 19 is a part of the manipulator 20 which, in this case, is an industrial robot with a plurality of movement axes, for example with six or eight movement axes. The manipulator 20 is numerically controlled such that the tool center point, i.e. the effective point of a tool firmly fitted on the manipulator arm 19, can be moved along a predetermined movement path. Programming of the manipulator 20 can be made such that the manipulator arm 19 with the tool secured thereto is manually guided along the intended processing line in a teaching phase. The path values recorded in this way are stored, and subsequently, the manipulator 20 is controlled such that the manipulator arm 19 performs the same movements in a controlled manner which were carried out in the teaching phase. The tool secured on the manipulator arm consists of the sewing machine 18 in this case.

On the manipulator arm 19, a linear guide 21 is secured along which a carriage 22 which carries the sewing machine 18 can be moved. The guide 21 is aligned transversely to the needle of the sewing machine 18 and it extends parallel to the seam line 17 to be produced. The carriage 22 is driven by a drive (not illustrated). This drive may consist of the drive motor 23 of the sewing machine, in which case the carriage movement may be produced by a cam disk moved by this drive motor 23.

According to FIG. 3, the drive motor 23 of the sewing machine 18 drives a drive shaft 25 via a belt drive 24, said drive shaft driving the components of the sewing machine in the known manner. The sewing machine comprises a sewing head 26 which is arranged in a fixed association with respect to the sewing machine housing 18*a*. Belonging to the sewing head 26 are the needle lever 27 which is fitted to a back and forth moving turned shaft 28 and carries the curved needle 29, a needle plate 30 which forms an abutment for the double-layered edge strip 16 and comprises a cutout for penetration of the needle 29, a presser 31 arranged opposite the needle plate 30 and a shuttle hook 32 which is arranged behind the needle plate 30 and contains the under-thread supply. The needle 29 is curved about the axis of the shaft 28.

During the penetration of the needle 29, the edge strip 16 is clamped firmly between the needle plate 30 and the presser 31. When the needle is pulled out of the edge strip 16, the needle plate 30 and the presser 31 move apart in order to release the edge strip. The opening and closing movement of the presser 31 is controlled by the needle lever 27 which, when the needle is pulled out of the material, engages a stop 33 of the presser 31 so that the presser is lifted from the edge strip 16 against the action of the spring 34 which pulls said presser in the direction of the needle plate 30.

The needle plate 30 is also removed from the edge strip when the needle is withdrawn. This is effected by the fact that an arm 35 carrying the needle plate 30 is moved by a cam control 36 synchronized with the needle lever movement.

On the needle plate 30 or on the presser 31, a sensor 37 is provided which detects the presence of the edge strip 16 and makes the sewing machine inoperative when an edge strip has not been detected. This sensor can be a light-cell barrier, for example, in which the light emitter is fitted on the needle plate 30 and the receiver on the presser 31.

Figure 4:
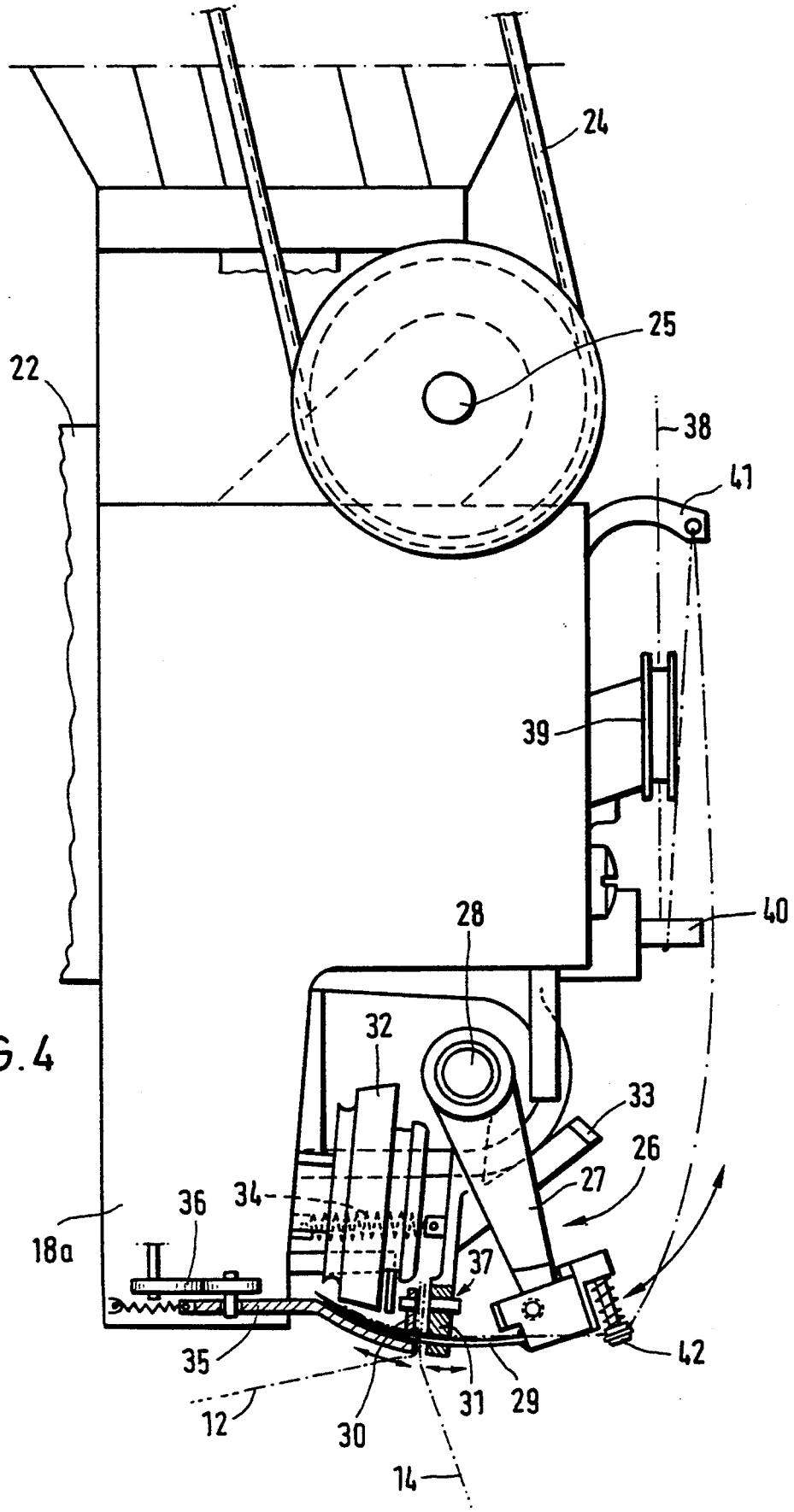

According to FIG. 4, the thread 38 coming from a yarn bobbin (not illustrated) passes over a roller 39 driven by a stepping motor and further over a diverting pin 40 to the thread take-up 41 movable up and down in the rhythm of the needle movement. From there, the thread 38 passes to a thread brake 42 provided on the needle lever 27 and further to the needle hole arranged close to the tip of the needle 29. The stepping motor driving the roller 39 is set into function in every cycle after completion of the upward movement of the thread take-up 41 in order to provide for the amount of thread which corresponds to the predetermined stitch length. A pressing roller presses the thread firmly against the roller 39 driven by the stepping motor such that the thread is moved by the roller 39 without slippage. When the roller 39 stops moving, it is held by the stepping motor so that no pulling of the thread from the thread supply by the pulling forces behind the roller 39 is possible.

It is assumed that the carriage 22 is in its forward end position in the movement direction of the manipulator arm 19. In this position, the location of penetration of the needle 29 into the material represents the tool center point of the manipulator. The manipulator arm 19 is moved by the manipulator 20 such that the tool center point moves along the intended seam line.

The drive motor 23 of the sewing machine 18 is controlled in dependence on the movement of the manipulator arm such that the stitch length (the way from penetration point to penetration point) remains constant, independently of the feeding speed. To this end, the speed component derived from the path encoders of the manipulator in seam direction is compared with the speed of the sewing machine motor. Before the tip of the needle 29 penetrates the edge strip 16, the needle plate 30 and the presser 31 are moved towards each other. Simultaneously, the carriage 22 is moved along the guide 21 opposite the feeding movement carried out by the manipulator arm 19 (along the intended seam line), and at a speed which corresponds to the feeding speed. Thereby, the sewing machine 18 stops relative to the holding device 10 or the workpiece during the penetration of the needle 29 into the material, whereas the manipulator arm 19 is continuously moved further. The requirement for this is that the manipulator arm 19 is aligned parallel to the intended seam direction. When the needle 29 has been withdrawn from the material, the carriage 22 is moved along the guide 21 into its front end position again, whereas the manipulator arm 19 continues its continuous feeding movement.

These movement conditions are shown in FIG. 5. Here, in the upper illustration, the course in time of the stitch movements s of the needle 29 is shown, the amplitude increasing the farther the needle tip is pushed forward from its withdrawal position through the needle plate 30. In the lower illustration, the absolute speed v of the sewing machine 18 is shown, $v_R$ being the constant feeding speed of the manipulator arm 19. As long as no stitch movements are performed, the sewing machine 18 is in its front end position with respect to the manipulator arm 19 and it moves at the feeding speed $v_R$. When a stitch movement is made, the sewing machine 18 moves along the guide 21 opposite to the direction of the feeding speed so that the absolute speed becomes zero. After withdrawal of the needle tip from the material, the sewing machine 18 is moved along the guide 21 into the front end position again, this feeding movement overlaying with the feeding speed $v_R$ of the manipulator arm 19. In the front end position, the carriage 22 remains until the next stitch is carried out. The drive of the carriage 22 with respect to the guide 21 is effected by the sewing machine drive and in synchronization with the needle movements.

Figure 6:
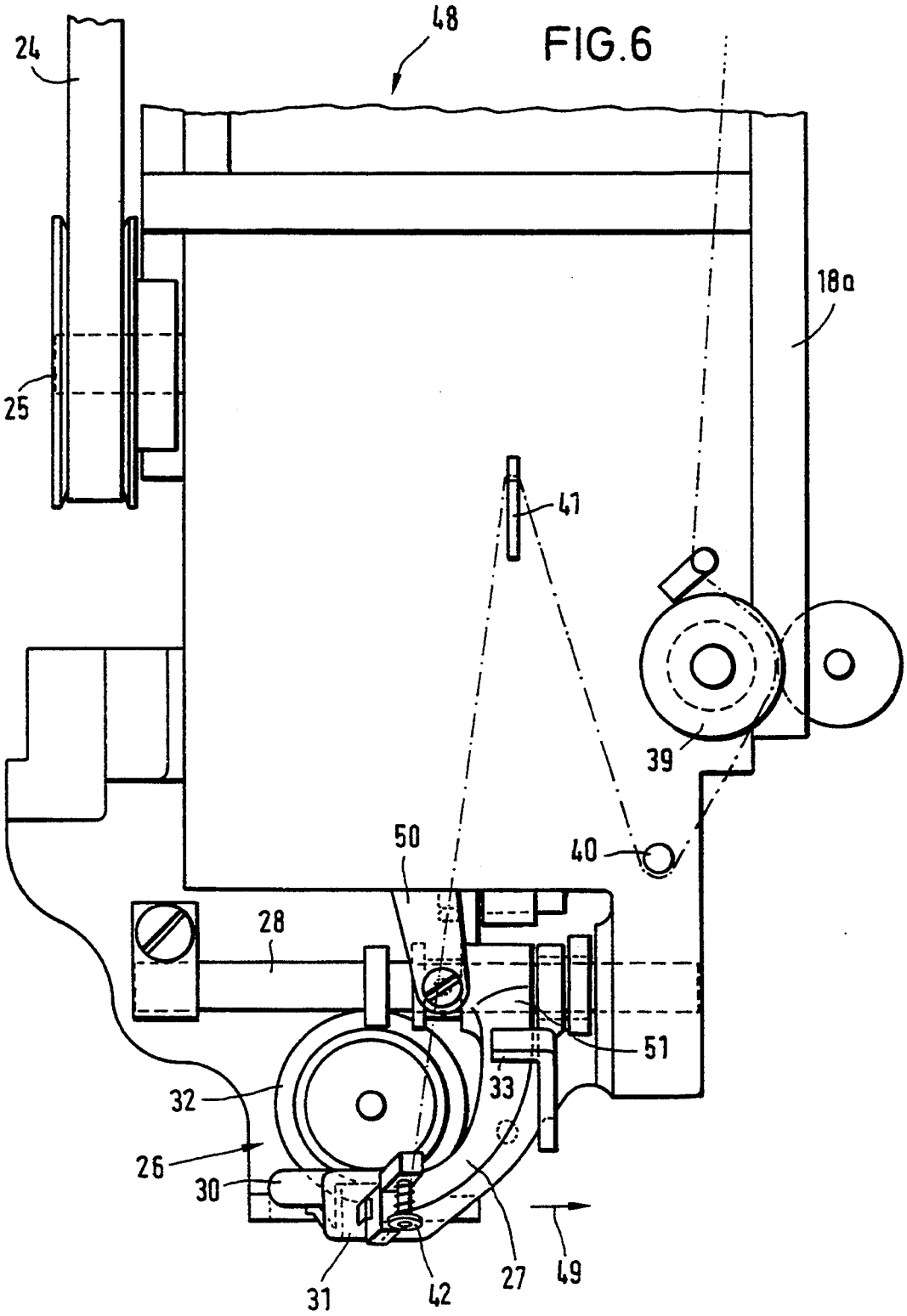

In the embodiment of FIG. 6, the sewing machine 48 is firmly and rigidly connected with the manipulator arm (not illustrated), and the components of the sewing head 26 are displaceable opposite to the direction of the intended sewing direction indicated by the arrow 49. The components of the sewing machine 48, insofar as they correspond to the components of the above-described sewing machine 18, are provided with the same reference numbers. The following description is restricted to the differences of the sewing machine 48 compared with the sewing machine 18.

On the sewing machine 48, the needle lever 27 is not rigidly connected with the shaft 28, but is displaceable along this shaft. In the same way, the arm carrying the presser 31 is secured to the shaft 28 for rotation therewith, but is displaceable along this shaft.

Displacement of the needle lever 27 and the presser 31 is effected by a fork 50 controlled by a cam disk, said fork engaging in an annular groove in a sleeve 51 located on the shaft 28 and being controlled synchronously with the needle drive. In a similar manner, the needle plate 30 and the shuttle hook 32 are displaceable in the direction of the arrow 49 and in the opposite direction.

The seam 17 is sewn on the workpiece such that the double-layered edge strip 16 outwardly protrudes from the cuttings. Subsequent to the completion of the seam, the workpiece is turned, the surfaces lying on the outside during production coming to lie on the inside.

Although a preferred embodiment of the invention has been specifically illustrated and described herein, it is to be understood that minor variations may be made in the apparatus without departing from the spirit and scope of the invention, as defined the appended claims.

I claim:

1. A device for making seams on objects comprising a holding device (10) for holding material (12, 14) to be sewn together, and a manipulator (20) carrying a sewing machine (18) which causes relative movement between the sewing machine (18) and said holding device (10) along an intended seam line by means of a manipulator arm (19) of said manipulator (20), characterized in that said sewing machine (18) includes a sewing head (26) with a needle plate (30) defining an abutment for the material (12, 14), a presser (31) of said sewing machine (18) for pressing the material (12, 14) against said needleplate (30), a needle (29) of said sewing machine head (26) being movable transversely with respect to the material (12, 14), and means for controlling the operation of said sewing head (26) such that said sewing head (26) is at a standstill relative to said holding device (10) during the penetration of said needle (29) into the material (12, 14).

2. The device according to claim 1 including means for controlling the operation of said manipulator arm (19) such that said sewing head (26) continuously moves at a feeding speed along the intended seam line, and means for driving said sewing head (26) relative to said manipulator arm (19) parallel to a feeding direction of said sewing head (26) such that said sewing head (26) is moved opposite to the feeding direction of said manipulator arm (19) during the penetrations and in the feeding direction of said manipulator arm (19) between penetrations.

3. The device according to claim 2, characterized in that said sewing head (26) is arranged on said sewing machine (18) in a fixed position, and said entire sewing machine (18) on the manipulator arm (19) is movable parallel to the feeding direction.

4. The device according to claim 2, including means for moving said sewing machine (18) relative to said manipulator arm (19) parallel to the feeding direction.

5. The device according to claim 1, including means for moving apart said needle plate (30) and said presser (31) when said needle (29) is moved out of the material, and are moved towards each other for clamping the material before said needle penetrates the material again.

6. The device according to claim 1, characterized in that at least one sensor (37) for detecting the presence of material between said presser (31) and said needle plate (30) is provided on said sewing head (26).

7. The device according to claim 1, characterized in that said needle (29) is arranged on a needle arm (27) connected with a shaft (28) for rotation therewith and is curved relative to said shaft (28).

8. The device according to claim 1, characterized in that said drive motor (23) of said sewing machine (18) is controlled in dependence on the movement of said manipulator arm (19) such that the stitch length remains constant independently of the feeding speed.

9. The device according to claim 1, characterized in that said sewing machine comprises a thread feed with a stepping motor which, for each cycle of the needle movement, provides a thread amount which corresponds to a set stitch length.

* * * * *